United States Patent [19]

Hori

[11] 4,329,899

[45] May 18, 1982

[54] DEVICE FOR CONVERTING ROTARY MOTION OF CRANK MECHANISM INTO LINEAR MOTION FOR A FLYING CUTTER

[75] Inventor: Shinichi Hori, Amagasaki, Japan

[73] Assignee: Asada Machinery Manufacturing Co., Ltd., Amagasaki, Japan

[21] Appl. No.: 148,913

[22] Filed: May 12, 1980

[30] Foreign Application Priority Data

Nov. 26, 1979 [JP] Japan ..... 54-153334

[51] Int. Cl.[3] ..... B26D 1/56

[52] U.S. Cl. ..... 83/320; 83/311; 83/318; 83/295; 83/37; 74/49; 464/117

[58] Field of Search ..... 83/295, 310, 311, 318, 83/324, 37, 38, 320; 74/49; 64/31, 10, 6

[56] References Cited

U.S. PATENT DOCUMENTS

| | | | |
|---|---|---|---|
| 2,476,473 | 7/1949 | Ashton | 64/31 X |
| 2,960,341 | 11/1960 | Emrick | 64/31 X |
| 3,309,953 | 3/1967 | Hallden | 83/311 |
| 3,915,041 | 10/1975 | Trofimov et al. | 83/311 |
| 3,946,630 | 3/1976 | Roehrig et al. | 83/311 |
| 4,196,645 | 4/1980 | Shimizu et al. | 83/37 |

FOREIGN PATENT DOCUMENTS

| | | | |
|---|---|---|---|
| 2734132 | 7/1977 | Fed. Rep. of Germany | 83/295 |

*Primary Examiner*—Donald R. Schran
*Attorney, Agent, or Firm*—Gabriel P. Katona

[57] ABSTRACT

A device for converting the rotary motion of a crank mechanism into the linear motion of a slide block. In order to enable the slide block to make a constant velocity motion in an angular range required by the crank pin and extending from the crank pin in opposite directions, the device is designed to control the angular velocity of the crank mechanism along the ideal angular velocity variation curve.

6 Claims, 9 Drawing Figures

DEVICE FOR CONVERTING ROTARY MOTION OF CRANK MECHANISM INTO LINEAR MOTION FOR A FLYING CUTTER

BACKGROUND OF THE INVENTION

The present invention relates to a device for converting the rotary motion of a crank mechanism into the linear motion of a slide block.

In a device which enables a slide block to make a horizontal linear motion by a crank mechanism, if the angular velocity of the crank mechanism is constant, the horizontal velocity component of said angular velocity changes momentarily as the crank mechanism rotates, with the result that the slide block makes a horizontal nonuniform velocity linear motion. If, therefore, the slide block is to make a horizontal uniform linear velocity motion, the angular velocity of the crank mechanism must be controlled. Methods of such control include one of electrically controlling the drive motor for the crank mechanism.

SUMMARY OF THE INVENTION

According to the invention, the control of the angular velocity of a crank mechanism is performed mainly by mechanical means to minimize the required amount of angular velocity control of the motor, thereby greatly reducing motor loads and allowing high speed operation of the moving parts.

The invention will now be described in more detail with reference to the accompanying drawings.

BRIEF DESCRIPTION OF THE DRAWINGS

FIG. 8 is a side view, in longitudinal section, of an arrangement illustrating an embodiment of the present invention.

DESCRIPTION OF THE PREFERRED EMBODIMENT

Figure 1:
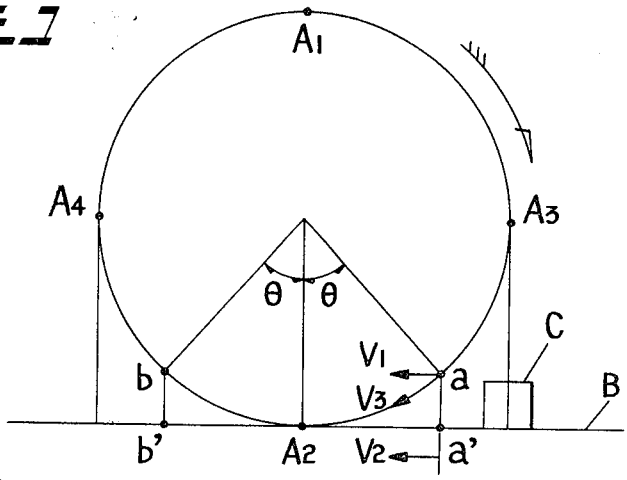
FIG. 1 illustrates the principle of a device for conversion into horizontal linear motion in a crank mechanism.
Figure 2:
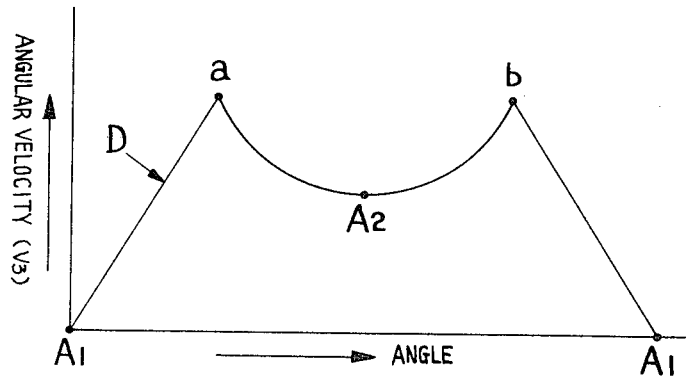
FIG. 2 is a graph illustrating an example of usage of a cross type universal joint, serving to illustrate the principle of the present invention.

FIG. 1 illustrates a path of rotation A described by a crank mechanism including a slide block B which is to be moved parallel to a tangential line B passing through the lower dead point A2 on the path of rotation A. If the slide block C is to make a constant velocity motion in a particular region between points a' and b' during its reciprocating motion in the horizontal reciprocating motion range of A3 to A4, it is necessary to control the angular velocity A3 of the crank mechanism by controlling the rotative speed of the motor, which is a drive source for the crank mechanism, so that the horizontal velocity component V1 of the crank mechanism may be maintained at a constant velocity V2. A curve D in FIG. 2 illustrates an example of a method of controlling the angular velocity of the crank mechanism, wherein the crank mechanism starts rotating from the upper dead point A1 while increasing its angular velocity V3 through point A3 until point a is reached where the angular velocity V3 is at a maximum, from which it is then differentially reduced until the lower dead point A2 is reached where the angular velocity V3 is equal to the constant angular velocity V2, from which it is then differentially increased until point b is reached, from which it is reduced through point A4 until the upper dead point A1 is reached. The angular velocity V3 of the crank mechanism in the constant velocity control range of points a to b in the curve D is obtained by the formula V2 $1/\cos\theta$, the ideal angular velocity variation curve obtained from said formula being as shown at E in FIG. 3. For the attainment of the angular velocity control of the crank mechanism described above, there may be contemplated an electrical method of angular velocity control which comprises detecting the rate of travel of the crank mechanism (i.e., slide block) and the angular phase of the crank mechanism, feeding the detected data back to the rotary drive section of the motor, comparing said fed-back values with the rotative speed of the motor, and changing the rotative speed of the motor. With such control method, however the inertia of the motor greatly influences control accuracy because of the high harmonized speed and large-sized equipment, and the burden of electrical acceleration and deceleration on the motor increases, thus making it difficult to obtain the ideal angular velocity variation curve E shown in FIG. 3.

The present invention has been accomplished with the above in mind and provides a novel device for conversion into linear motion, wherein the control of the angular velocity of a crank mechanism required for constant velocity motion is mechanically effected to minimize the required amount of control of the rotative speed of the motor to greatly reduce the load on the motor while achieving a high speed operation which can never be expected of the electrical control of the motor.

Figure 3:
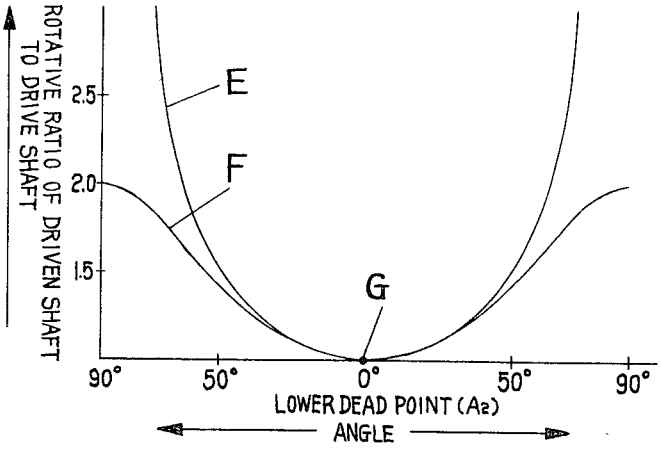
FIG. 3 illustrates the principle of the present invention.

More particularly, with attention paid to the nonuniform motion of the cross type universal joint among the various types of universal joints, the principle underlying the invention consists in placing a motor drive shaft and a crank shaft out of axial alignment with each other, connecting said two shafts together by using an intermediate shaft having a required angle of intersection with said shafts and a pair of cross type universal joints, with the yokes on the opposite ends of said intermediate shaft being 90 degrees out of phase with each other, the arrangement being such that the variations in the angular velocity of the crank shaft which are naturally produced during the transmission of torque from said drive shaft to said crank shaft through said cross type universal joints and intermediate shaft cause the angular velocity of said crank shaft to vary in such a manner as to closely approximate to the ideal angular velocity variation curve E shown in FIG. 3 in a region between said point a and b, so as to enable the slide block to move at an approximately constant velocity.

Figure 4:
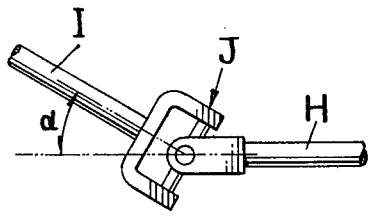
FIG. 4 is a schematic view illustrating a cross type universal joint.
Figure 5:
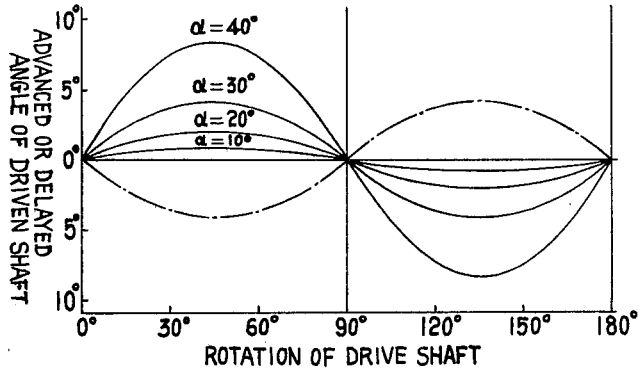
FIG. 5 is a graph illustrating variations in the angular velocity of a driven shaft in a cross type universal joint.

It is known in the art that, of universal joints, a cross type universal joint J including a cross connecting pin which connects a drive shaft H and a driven shaft I, as shown in FIG. 4, has, unlike constant velocity universal joints, such as a ball joint, a nature such that so long as the drive and driven shafts H and I are operatively connected together at an angle $\alpha$, even if the drive shaft H is rotated at a constant angular velocity, the driven shaft I is rotated periodically faster and slower, with its angular velocity sinusoidally varying with time. The amount of variation in the angular velocity of the driven shaft I relative to the driving shaft H is obtained theoretically by the formula:

$$\cos \alpha/(1-\sin^2\theta\text{-}\sin^2\alpha)$$

where $\theta$ is the angle of rotation of the drive shaft H, and the resulting variations are as indicated by the graph of FIG. 5. Therefore, in order to compensate for variations in the angular velocity of the driven shaft I, it is usual practice, as shown in FIG. 6, to use a pair of cross type universal joints J1 and J2 and interpose an intermediate shaft K between said cross type universal joints J1 and J2 to assure that the drive shaft H and the driven shaft I are in phase with each other with respect to rotation.

Figure 6:
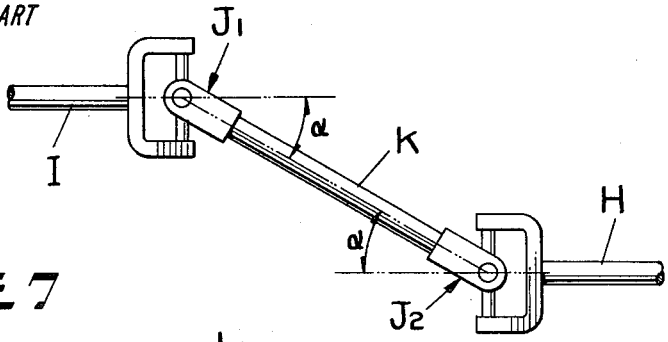
FIG. 6 PRIOR ART
FIG. 6 illustrates the common way of using a pair of cross type universal joint.

In contrast to the usual practice of eliminating said variations in the angular velocity of the driven shaft H by using the intermediate shaft K and two cross type universal joints J1 and J2, as shown in FIG. 6, the present invention is intended to augment said angular velocity variations. More particularly, in the case of FIG. 6, if angular velocity variations as shown in a solid line in FIG. 5 are produced in the intermediate shaft K during transmission of torque from the drive shaft H to the intermediate shaft K, angular velocity variations (shown in a dot-dash line in FIG. 5) which are 90 degrees out of phase with the first-mentioned variations are produced in the driven shaft I during transmission of torque from the intermediate shaft K to the driven shaft I, the relation between these two types of angular velocity variations being such that they cancel each other to assure that the driven shaft I is rotated at the same (instantaneous) angular velocity as the drive shaft H. If, however, the coupling yokes L1 and L2 on the opposite ends of the intermediate shaft are connected to the drive and driven shafts H and I, respectively, so that the yokes are 90 degrees out of phase with each other, the angular velocity variations produced during transmission of torque from the drive shaft H to the intermediate shaft K are in phase with the angular velocity variations produced during transmission of torque from the intermediate shaft K to the driven shaft I. Thus, the net angular velocity variations produced in the driven shaft have been augmented and are expressed by the formula $$[\cos \alpha/(1-\sin^2 \theta \sin^2 \alpha)]^2$$

Figure 7:
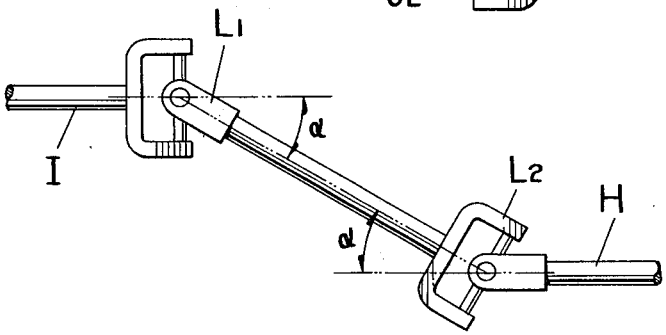
FIG. 7 illustrates the way a pair of cross type universal joints are used according to the present invention.
Figure 3:
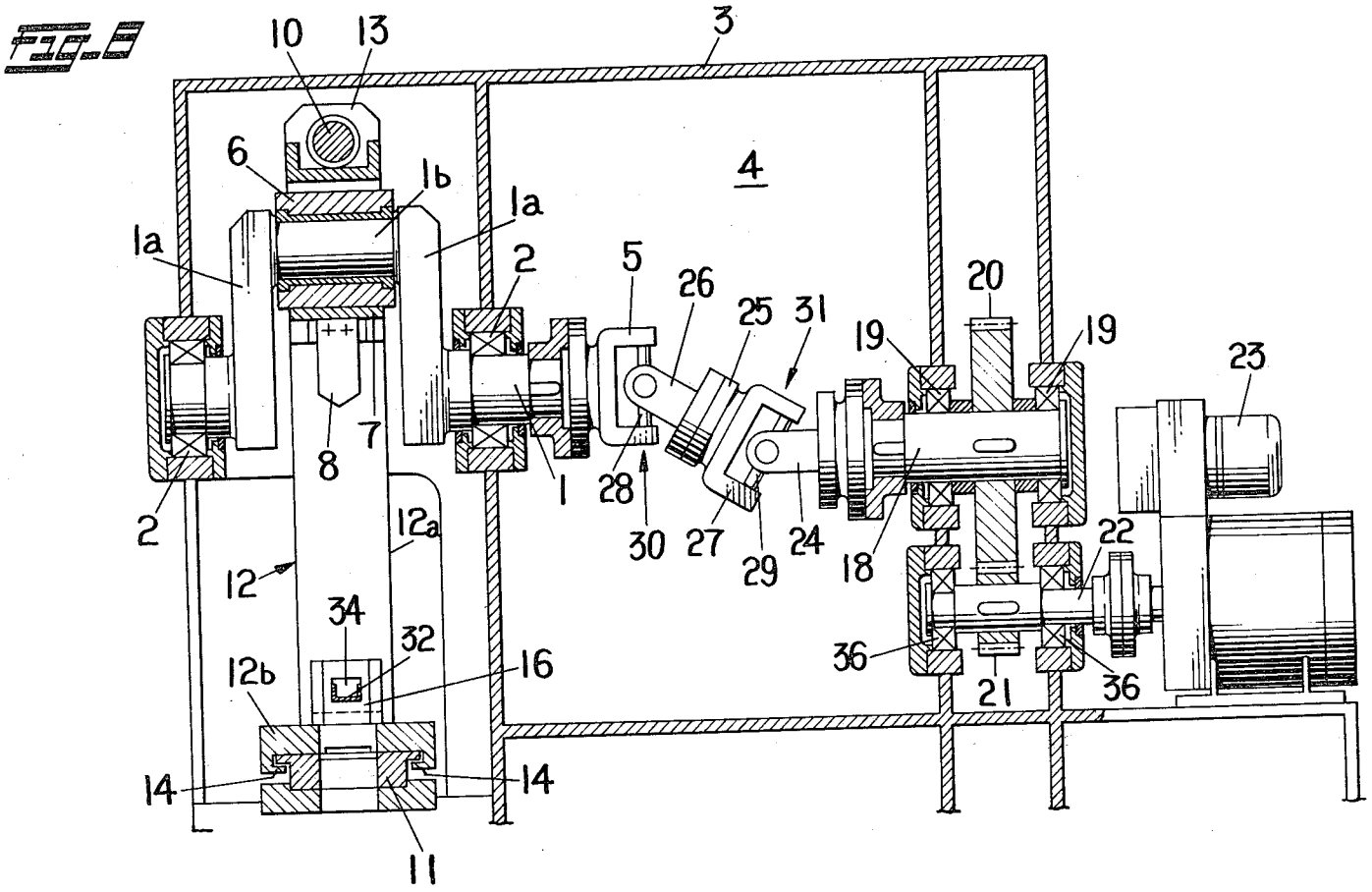

The present invention is based on this principle, using a pair of cross type universal joints combined together in a unique usage, as shown in FIG. 7 with universal joints L1 and L2, directly opposite to the conventional usage of cross type universal joints, so as to connect said drive shaft to the crank shaft, whereby angular velocity variations for the crank shaft are derived from the drive shaft which is rotating at a uniform angular velocity, thereby increasing and decreasing the angular velocity in the path of rotation A of the crank mechanism. With this arrangement, as compared with the ideal angular velocity variation curve E shown in FIG. 3, the angular velocity variation curve for the crank mechanism appears as indicated at F as a result of the use of cross type universal joints. Thus, if the device is so arranged that the minimum angular velocity of the crank shaft upon arrival of the crank shaft at the lower dead point is equal to the minimum angular velocity on the ideal angular velocity variation curve E (as shown at point G in FIG. 3), then the angular velocity of the crank mechanism will vary close to the ideal angular velocity variation curve E even if substantial rotative speed control is not electrically applied to the motor. In this connection, it will be noted that as $2\theta$ in FIG. 1 approaches 90 degrees, the angular velocity V3 in the ideal angular velocity variation curve E approaches infinity, thus making it impossible to design such a device. Therefore, the points a and b which determine the angular velocity control range are selected so that $2\theta$ is less than 90 degrees. Therefore, it is seen that the application of only a small amount of electrical, rotative speed control to the motor to compensate for the angular velocity difference between the two curves E and F in said angular velocity control range between points a and b is enough to cause the angular velocity of the crank mechanism to vary according to the ideal angular velocity variation curve, so that the slide block makes a constant velocity motion.

Figure 9:
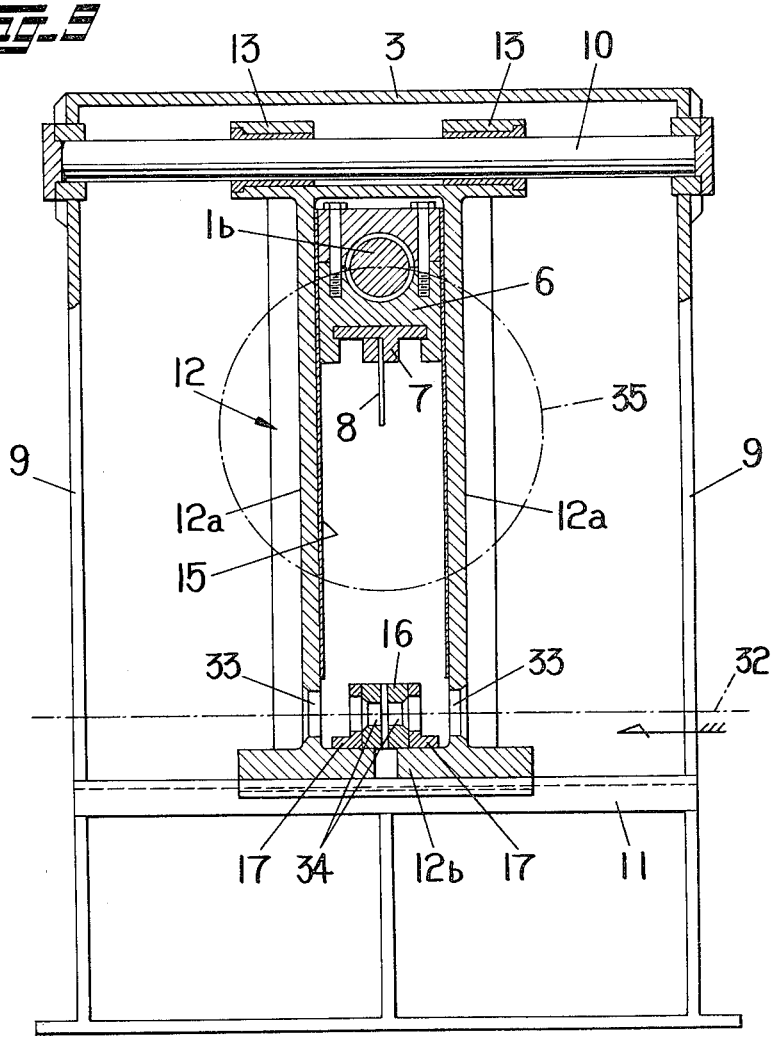
FIG. 9 is a front view, in longitudinal section, of the principal portion of said arrangement.

The principle of the present invention is applicable to a cutting apparatus, boring or drilling apparatus, embossing apparatus, printing apparatus and the like. FIGS. 8 and 9 illustrate by way of example the invention as applied to a cutting apparatus.

The numeral 1 designates a crank shaft supported in a machine frame 3 for rotation in bearings 2, one end of said crank shaft 1 extending into an oil chamber 4 provided in said machine frame 3, and said projecting end being formed with a yoke 5 for a universal joint. A crank pin **1*b* extending between a pair of crank arms 1*a* which perpendicularly intersect the crank shaft 1 has a slider 6 rotatably mounted thereon and also has a cutter 8 attached to the lower surface thereof at a cutter attaching seat 7. Installed above the crank shaft 1 is a guide shaft 10 horizontally extending between opposed lateral walls 9. Disposed below said guide shaft 10 is a rail block 11 horizontally installed to extend between the opposed lateral walls 9. A slide block 12 is horizontally slidably mounted between the guide shaft 10 and the rail block 11 through sleeves 13 at its upper end fitted on the guide shaft 10 and engagement pawls 14 at its lower end engaged with the rail block 11. By fitting said slider 6 in a guide groove 15 defined between vertically extending guide frames 12*a* installed on said slide block 12, the slide block 12 can be horizontally reciprocated in operative association with the up and down movement of said slider 6**.

Dies 16 are fixed to the lower frame **12*b* of the slide block 12 by a die attaching seat 17 directly below the cutter 8 on said slider 6. The numeral 18 designates a drive shaft mounted in bearings 19 inside the oil chamber 4 and horizontally extending below and parallel to said crank shaft 1, said drive shaft 18 having a large gear wheel 20 mounted thereon. An output shaft 22 having a small gear wheel 21 mounted thereon which is meshing with said large gear wheel is supported on bearings 36 inside the oil chamber 4, one end of said output shaft 22 being operatively connected to a motor 23 placed outside the oil chamber 4. The drive shaft 18 has a universal joint yoke 24 formed thereon at its end associated with the crank shaft 1, and an intermediate shaft 25 is interposed between the drive shaft 18 and crank shaft 1 at a required angle of intersection with the shafts. The intermediate shaft 25 is provided with universal joint yokes 26 and 26 at its opposite ends which are coupled with the yokes 5 and 24 of the shafts 1 and 18, respectively, by cross type connecting pins 28 and 29, respectively. Thus, the crank shaft 1 and intermediate shaft 25 are coupled by a cross type universal joint 30, while the intermediate shaft 25 and driven shaft 18 are coupled by a cross type universal joint 31. In this case, the yokes 26 and 27 of the intermediate shaft 25 are 90 degrees out of phase with each other so that angular velocity variations naturally produced by the presence of the universal joint 31 between the drive shaft 18 and the intermediate shaft 25 are augmented by the universal joint 30 and transmitted to the crank shaft 1**.

In this cutting apparatus, a workpiece 32, such as a section bar, is traveling at all times in the direction of arrow shown in FIG. 9 through a guide hole 33 formed in the slide block 12 and then through holes 34 in the dies 16. When the slider 6 is waiting at the upper dead point, a cutting signal is issued to start the motor 23 which then imparts torque to the crank shaft 1 successively through the output shaft 22, gear wheels 21, 22, drive shaft 18, universal joint 31, intermediate shaft 25 and universal joint 30, whereby the crank pin 1*b* and the slider 6 rotatably fitted thereon are lifted and lowered while describing a circular path 35 shown in FIG. 9, and concurrently therewith the slide block 12 is horizontally reciprocated. The crank shaft 1 derives from the combination of said cross type universal joints angular velocity variations as indicated by the curve F in FIG. 3 previously described in connection with the principle of the invention, said angular velocity variations being transmitted to the slide block 12 through the pin 1*b* and slider 6. On the other hand, electrical, rotative speed control for compensating for the difference between the curves E and F of FIG. 3 is applied to the motor 23. As a result, the rate of horizontal travel of the cutter 8 and slide block 12 at the time of cutting is controlled to be equal to the rate of travel of the workpiece 32. Just before the slider 6 which is descending from the upper dead point with said start of the motor 23 reaches the lower dead point, the cutter 8 starts to enter the dies 16, and the cutter cuts the workpiece 32 in such a condition that the horizontal velocity of the cutter 8 is equal to the rate of travel of the workpiece 32, said cutting being completed when the slider 6 reaches the lower dead point, whereupon it moves upwardly with the cutter upwardly withdrawn from the dies 16. When the slider 6 reaches the upper dead point upon completion of one revolution of the crank shaft 1, a stop signal is transferred to the motor 23 and the cutter 8 stops at its upper position to be ready for the next cutting operation. In this connection, it is to be noted that it is, of course, possible to operate the crank mechanism at all times in harmony with the rate of travel of the workpiece, without giving such stop signal, so as to cut the workpiece into required lengths in a continuous manner.

As has been described so far, according to the invention, in connecting the crank shaft to the drive shaft from the motor by an intermediate shaft a required angle of intersection with them, a pair of cross type universal joints are interposed between the intermediate shaft and the first-mentioned two shafts, with the yokes on the opposite ends of said intermediate shaft being 90° out of phase with each other, the arrangement being such that angular velocity variations produced by the presence of one universal joint are augmented by the presence of the other universal joint, such augmented angular velocity variations being imparted to the crank shaft, thus enabling the angular velocity of the crank mechanism to mechanically approximate to the ideal angular velocity variation curve. Therefore, in order to enable the variations in the angular velocity of the crank mechanism to coincide with the ideal angular velocity variation curve, it is only necessary, as is apparent from FIG. 3, to apply a small amount of electrical, rotative control to the motor, so that the load on the motor can be reduced while allowing the high speed operation of the present inventive device.

It will be understood by those skilled in the art that various modification of, additions to and changes in the disclosed particulars are possible, without departing from the spirit and scope of the invention, and these are considered to fall within the scope of the present invention.

What is claimed is:

1. A device for converting rotary motion into uniform linear motion, comprising: a rotatably drivable crank mechanism having a crank shaft; a slide block; means connecting the slide block to the crank mechanism to effect the linear motion thereof in response to rotation of the crank mechanism; rotary drive means having a drive shaft which is out of axial alignment with said drive shaft; and means operatively connecting the drive shaft to the crank shaft to effect uniform linear motion of the slide block comprising an intermediate shaft disposed at a given angle of inclination with respect to the drive shaft and crank shaft and two out of phase cross type universal joints connected to opposite ends of the intermediate shaft and to the crank and drive shafts at a given angle of intersection.

2. The device according to claim 1, wherein the connecting means comprises horizontally juxtaposed guide members, a slider moved by said crank mechanism along a guide groove in said slide block in a direction at right angles to the direction of movement of said slide block and an attaching seat formed on said slider.

3. The device according to claim 1, wherein the two joints comprise connecting yokes on the opposite ends of said intermediate shaft disposed out of phase with each other by a given angle.

4. The device according to claim 3, wherein said phase difference is 90 degrees.

5. The device according to claim 2, further comprising a cutter attached to said attaching seat.

6. The device according to claim 5, further comprising dies mounted on said slide block and associated with said cutter.

* * * * *